US009433329B2

(12) United States Patent
Joseff et al.

(10) Patent No.: US 9,433,329 B2
(45) Date of Patent: Sep. 6, 2016

(54) WASH CLOTH

(71) Applicants: Joribeth Joseff, Bloomfield Hills, MI (US); Jennifer Fine, New York, NY (US)

(72) Inventors: Joribeth Joseff, Bloomfield Hills, MI (US); Jennifer Fine, New York, NY (US)

(73) Assignee: JB Collectives, LLC, Bloomfield Hills, MI (US)

( * ) Notice: Subject to any disclaimer, the term of this patent is extended or adjusted under 35 U.S.C. 154(b) by 0 days.

(21) Appl. No.: 14/598,558

(22) Filed: Jan. 16, 2015

(65) Prior Publication Data

US 2015/0196171 A1 Jul. 16, 2015

Related U.S. Application Data

(60) Provisional application No. 61/928,029, filed on Jan. 16, 2014.

(51) Int. Cl.

| | |
|---|---|
| ***A47K 7/02*** | (2006.01) |
| ***A47L 13/18*** | (2006.01) |
| *A41D 13/08* | (2006.01) |

(52) U.S. Cl.

CPC ..... *A47K 7/02* (2013.01); *A47L 13/18* (2013.01); *A41D 13/082* (2013.01); *A41D 13/087* (2013.01)

(58) Field of Classification Search

CPC ..... A47K 7/02; A47K 7/03; A47L 13/18; A47L 13/19; A41D 13/08; A41D 13/081; A41D 13/082; A41D 13/084; A41D 13/087; A41D 19/01517; A41D 2600/20

USPC ..... 15/227; 2/16, 20, 21, 159, 160, 161.6, 2/161.8, 162, 163

See application file for complete search history.

(56) References Cited

U.S. PATENT DOCUMENTS

| | | | | |
|---|---|---|---|---|
| 731,583 | A * | 6/1903 | Love et al. | A46B 5/002 15/107 |
| 804,406 | A * | 11/1905 | Hungad | A41D 13/087 2/21 |
| 4,893,955 | A * | 1/1990 | Zielinski | A46B 5/04 15/227 |
| 5,528,772 | A * | 6/1996 | Cheek | A63B 71/148 2/161.1 |
| 5,933,863 | A * | 8/1999 | Monsue | A41D 13/087 2/159 |
| 6,209,137 | B1 * | 4/2001 | Wallick | A41D 13/087 2/159 |
| D552,355 | S | 10/2007 | Roehrig | |
| 7,674,058 | B2 | 3/2010 | Berger Sharp et al. | |
| 8,578,548 | B1 | 11/2013 | Costello et al. | |
| 2003/0213081 | A1 * | 11/2003 | Garcia | B43K 23/016 15/227 |
| 2005/0142519 | A1 | 6/2005 | Atzori | |
| 2006/0195966 | A1 * | 9/2006 | Martin | A41D 19/01594 2/160 |
| 2007/0028341 | A1 * | 2/2007 | Smith | A61F 5/50 2/16 |
| 2010/0269235 | A1 * | 10/2010 | Parks | F41H 1/02 2/2.5 |
| 2010/0306945 | A1 | 12/2010 | Methfessel | |
| 2013/0252206 | A1 | 9/2013 | Lee | |
| 2013/0269134 | A1 | 10/2013 | Lin | |
| 2014/0289927 | A1 * | 10/2014 | Defour | A41D 13/082 2/20 |

FOREIGN PATENT DOCUMENTS

| | | |
|---|---|---|
| DE | 10215805 C1 | 8/2003 |
| WO | 9616610 A1 | 6/1996 |

* cited by examiner

*Primary Examiner* — Mark Spisich

(74) *Attorney, Agent, or Firm* — Dickinson Wright PLLC

(57) ABSTRACT

The aspects of the present disclosure provide a wash cloth for cleaning all areas of a user or an individual's body. The wash cloth includes at least one finger cot. The at least one finger cot has a first side made of a soft absorbing material opposite a second side made of a microfiber material. The first side and second side are fastened together. The wash cloth includes a palm portion in communication with the first side of the at least one finger cot. The wash cloth further includes an elastomeric portion. The elastomeric portion may be in communication with and extends across the palm portion of the wash cloth. The elastomeric portion may be configured to fit over the user's hand and maintains the placement of the wash cloth over the user's hand.

16 Claims, 6 Drawing Sheets

WASH CLOTH

RELATED APPLICATIONS

This application claims the benefit of U.S. Provisional Application No. 61/928,029 filed on Jan. 16, 2014.

FIELD OF THE INVENTION

The present invention relates generally to a hygiene device for cleaning individual's body and in particular, a wash cloth for cleaning a baby, small child, teenage, adult, or elderly person.

BACKGROUND OF THE INVENTION

Hygienic devices for cleaning an individual's body are well-known. These devices may include a wash cloth used for cleaning an individual's body such as a baby or small child, a teenager, an adult, and an elderly person. Other hygiene devices may include toothbrushes or other brush-like devices specifically used for cleaning the individual's body, teeth, and gums. However, such devices are not always ideal, effective when used, appropriate for individuals under a certain age, or easy to use on another individual needing assistance.

In regards to wash cloths, the cloths are typically made of a soft material and are in a small square or rectangular shape. However, such cloths are difficult for an individual to use because of the shape and even more difficult for a parent to maneuver when holding a baby or small child. Additionally, such cloths are difficult when utilized by the small child, the elderly, or a person assisting the elderly because of their physical abilities. Moreover, such cloths are not able to effectively clean small crevices of the individual's body because of the shape of the wash cloth.

In regards to other hygiene devices, toothbrushes and other brush-like devices are inappropriate for the use by some individuals. Specifically, toothbrushes and other brush-like device should not be used by babies or small children to clean their bodies, teeth, and gums as the bristles may be too harsh on their skin or gums. Moreover, the elderly should not use other brush-like devices for the cleaning their body or gums because of the abrasive nature of such devices against their delicate skin. A need exists for a device for use by all individuals.

As a result, various wash cloths and other hygiene devices such as thimbles with bristle, thimbles without bristle, and other glove like structures were developed to fit on an individual's hand. However, such devices still pose problems in the area of hygiene since the wash cloths and other hygiene devices do not effectively stay on a user or a person assisting an individual.

Thus, a need exists for a wash cloth that is easy for an individual such as a child, adult, or elderly person to use, allows the individual to maneuver around the body of another individual easily, cleans small crevices of the individual's body, and stays on the individual's hand.

SUMMARY OF THE INVENTION

The aspect of the present disclosure provides a wash cloth for cleaning all areas of a body.

An aspect of the wash cloth includes at least one finger cot. The at least one finger cot has a first side made of a soft absorbing material opposite a second side made of a microfiber material. The first side and second side are fastened together by a seam and form an apex. Another aspect of the wash cloth includes a palm portion in communication with the first side of the at least one finger cot. The wash cloth further includes an elastomeric portion. The elastomeric portion may be in communication with and extends across the palm portion of the wash cloth. The elastomeric portion may be configured to fit over the user's hand and maintains the placement of the wash cloth over the user's hand.

The aspects of the present disclosure provide various advantages. For example, the design of the wash cloth allows the user to maneuver easily and safely around their body or the body of another individual such as a baby, a physically disabled person, or elderly person during use since the wash cloth fits over the user's hand and fingers. Additionally, the design of the wash cloth and specifically, the finger cot allows the user to clean small crevices of the user or another individual's body. Furthermore, the materials the wash cloth is made to remove dirt and bacteria easily. The wash cloth may be cleaned or washed easily, for example, by hand wash or washing machine based on the materials the wash cloth is made of. The elastomeric portion allows the wash cloth to stay on the user's hand during use. Moreover, the elastomeric portion allows for the wash cloth to hang dry which prevents the wash cloth from coming into contact with materials or surfaces harboring bacteria.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION OF THE ENABLING EMBODIMENTS

Detailed examples of the present disclosure are provided herein; however, it is to be understood that the disclosed examples are merely exemplary and may be embodied in various and alternative forms. It is not intended that these examples illustrate and describe all possible forms of the disclosure. Rather, the words used in the specification are words of description rather than limitation, and it is understood that various changes may be made without departing from the spirit and scope of the disclosure. As those of ordinary skill in the art will understand, various features of the present disclosure as illustrated and described with reference to any of the Figures may be combined with features illustrated in one or more other Figures to produce examples of the present disclosure that are not explicitly illustrated or described. The combinations of features illustrated provide representative examples for typical applications. However, various combinations and modifications of the features consistent with the teachings of the present disclosure may be desired for particular applications or implementations.

The aspects disclosed herein provide a wash cloth for cleaning a user or an individual's body. The wash cloth may be configured to fit over a user's hand and may further be secured to the user's hand. The wash cloth may include one or more finger cots to receive one or more of the user's fingers. The finger cots may have a first side opposite a second side. The wash cloth may include a palm portion designed to engage the user's palm when the finger cot(s) are disposed over the user's finger(s). The palm portion may be connected to the first side of the finger cot. The palm portion may have an outer facing side and an inner facing side. The inner facing side may engage the user's palm. The wash cloth also includes an elastomeric portion extending across the inner facing side of the palm portion. The elastomeric portion may be attached to the edge of the palm portion. The elastomeric portion may be configured to slide over the back of the user's hand. The wash cloth is designed to remove dirt and bacteria from the user or another individual. The wash cloth is easy for the user to use, allows the user to maneuver easily around the user's body or another individual's body such as a baby, a small child, or an elderly person, cleans small crevices of the user's or individual's body, and stays on the user's hand while cleaning their body or another individual.

Figure 1:
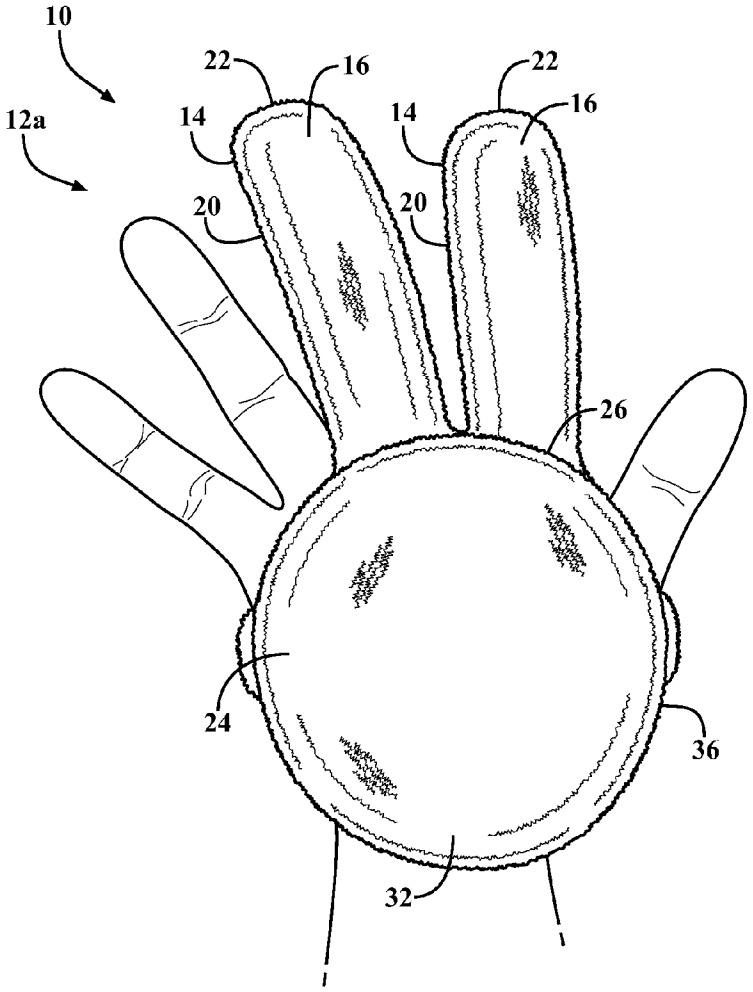
FIG. 1 is an illustration of a palm view of a wash cloth on a user's hand in accordance with the present disclosure.

According to FIG. 1, an illustration of a palm view of a wash cloth 10 on a user's hand 12*a* in accordance with the present disclosure is provided. As described above, the wash cloth 10 may be configured to fit over the user's hand 12*a*. As such, the wash cloth 10 may include at least one finger cot 14. The at least one finger cot 14 may have a first side 16 opposite a second side 18. The first side 16 and second side 18 may be fasten together at a seam 20 and may form an apex 22. The first side 16 may be made of a soft absorbing material such as, but not limited to terry cloth or cotton. The first side 16 may be configured to remove dirt and bacteria from the user or another individual's body. Moreover, the wash cloth 10 may be used with all types of soap since the first side 16 is made of terry cloth or another soft absorbing material. Additionally, in a preferred embodiment, the at least one finger cot 14 may be two finger cots. In an alternative embodiment, the at least one finger cot 14 may be five finger cots.

The wash cloth 10 may also include a palm portion 24. The palm portion 24 may be connected to the first side 16 of the finger cot 14 and may form a second seam 26. In another embodiment, the palm portion 24 and finger cot 14 may be one piece of material and may not form a seam. The palm portion 24 may be configured to rest on or engage the palm of a user's hand 12*a*. Additionally, similar to the first side 16 of the finger cot 14, the palm portion 24 may be made of a soft absorbing material such as, terry cloth or cotton. However, one skilled in the art appreciates that the palm portion 24 may be made of another absorbing material. The terry cloth or other soft absorbing material allows for a comfortable feeling during use for either the user or individual the user is assisting. The material may also be configured to remove dirt and bacteria. One skilled in the art also appreciates the palm portion 24 may have a generally circular shape or any shape conducive to fit on the palm of a user's hand 12*a*. For example, the palm portion may have an oval shape. The palm portion 24 may have an edge 36.

In the preferred embodiment, the at least one finger cot 14 and the palm portion 24 fit over the user's finger 12*b* and hand 12*a*. In particular, the palm portion 24 engages on the palm of the user's hand as shown in FIG. 1.

Figure 2:
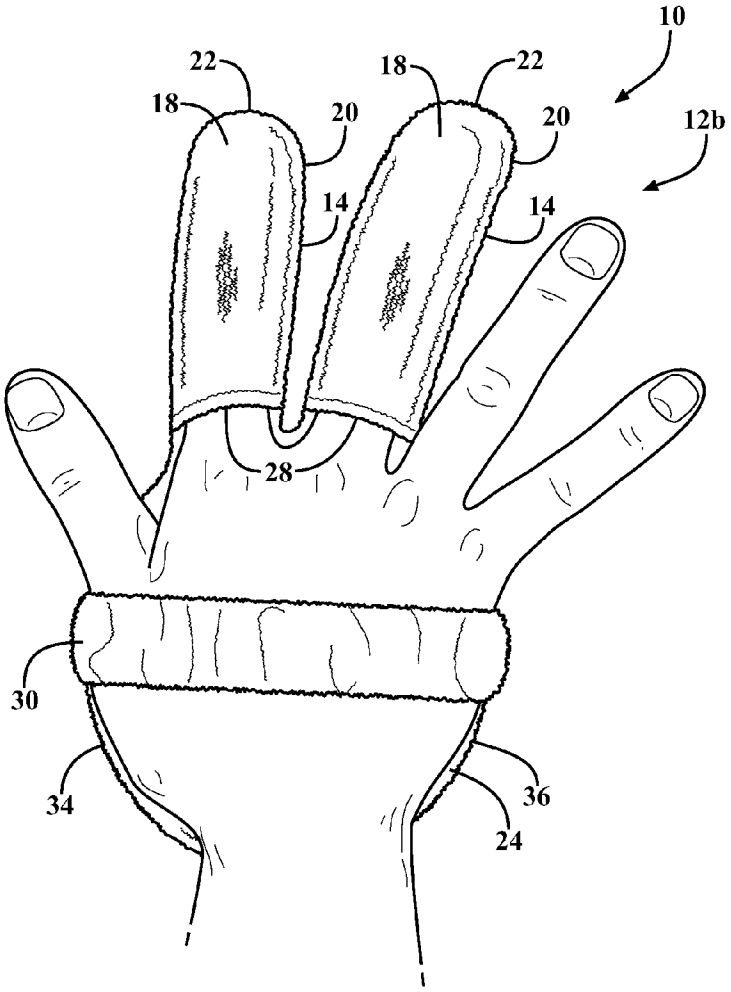
FIG. 2 is an illustration of a back view a wash cloth in accordance on the user's hand with the present disclosure.

In regards to FIG. 2, an illustration of a back of the hand 12*a* view of a wash cloth 10 disposed on a user's hand 12*a* in accordance with the present disclosure is provided. FIG. 2 shows the second side 18 of the at least one finger cot 14. The second side 18 of the finger cot may be made of a microfiber material, such as, but not limited to micro-jersey, micro-knit, or another moisture-proof material. Alternatively, the second side 18 may be made of the same material as the first side 16. The second side 18 of the at least one finger cot 14 may be opposite of the first side 16 and may be fasten by the seam 20. The first side 16 of the finger cot 14 and the second side 18 of the finger cot 14 may also form the apex 22. Additionally, the second side 18 of the at least one finger cot 14 may also have an elastomeric piece 28 extending across the second side 18 of the finger cot 14 to maintain position the at least one finger cot 14 on the user's finger 12*b* and to prevent the at least one finger cot 14 from sliding off or up the user's finger 12*b*. The elastomeric piece 28 may be located adjacent to an opening where the user's finger may be received.

As described in FIG. 1, the wash cloth 10 may include the palm portion 24. The palm portion 24 may have an outer facing side 32 and an inner facing side 34. The inner facing side 34 may engage the user's palm and the outer facing side 32 may face outwardly for the user to see. In FIG. 2, the inner facing side 34 of the palm portion 24 is shown. The palm portion 24 may be made of the same material as the second side 18 of the at least one finger cot 14.

The wash cloth 10 further includes an elastomeric portion 30. The elastomeric portion 30 may be an elastic strap attached to the palm portion 24 and in particular, the edge 36 of the palm portion 24. In an alternative aspect, the elastomeric portion 30 may be attached to the inner facing side 34 of the palm portion 24. The elastomeric portion 30 may also extend across the palm portion 24 of the wash cloth 10. Particularly, the elastomeric portion 30 may extend from a first portion of the edge 36 to a second portion of the edge 36. The strap may be configured to fit over the back 40 of the user's hand 12*a* to hold the wash cloth 10 in place, as shown in FIG. 2. The elastomeric portion 30 may be designed to slide or fit over the user's hand 12*a* and may engage the back side of the user's hand. The elastomeric portion 30 secures the wash cloth to the user hand for use and allows the user to maneuver around their body or the individual body that they are assisting easily and safely during use. The elastomeric portion 30 may be covered by a cloth portion 38 for comfort against the back of the user's hand, which may be made of any soft material. The elastomeric portion 30 may also be configured to act as a hanging mechanism which allows the wash cloth 10 to hang dry to prevent the wash cloth 10 from coming into contact with any other materials or surfaces that may contain dirt or bacteria.

Figure 6:
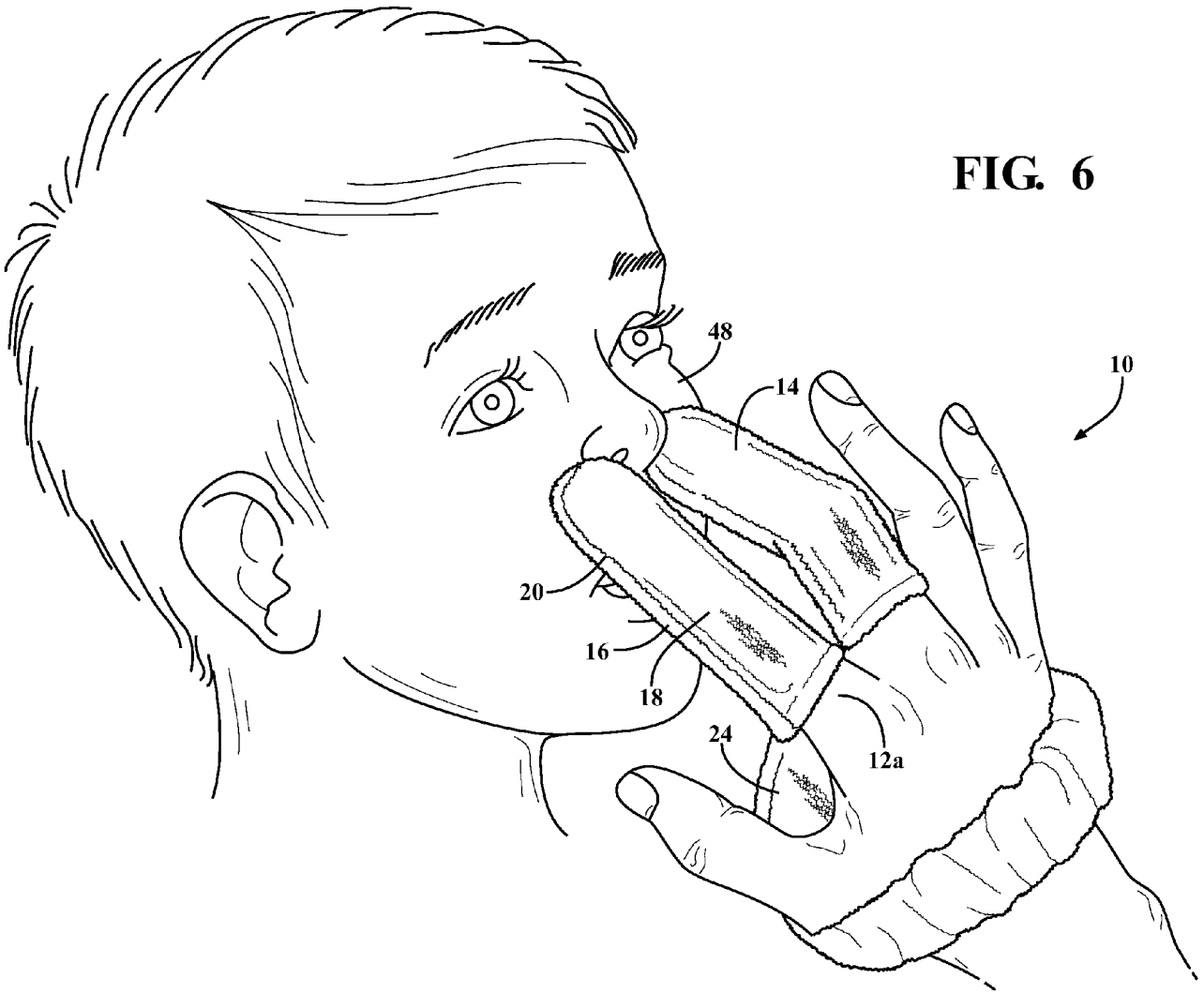
FIG. 6 is an illustration of a perspective view of a wash cloth cleaning an individual's face in accordance with an aspect of the present disclosure.
Figure 7:
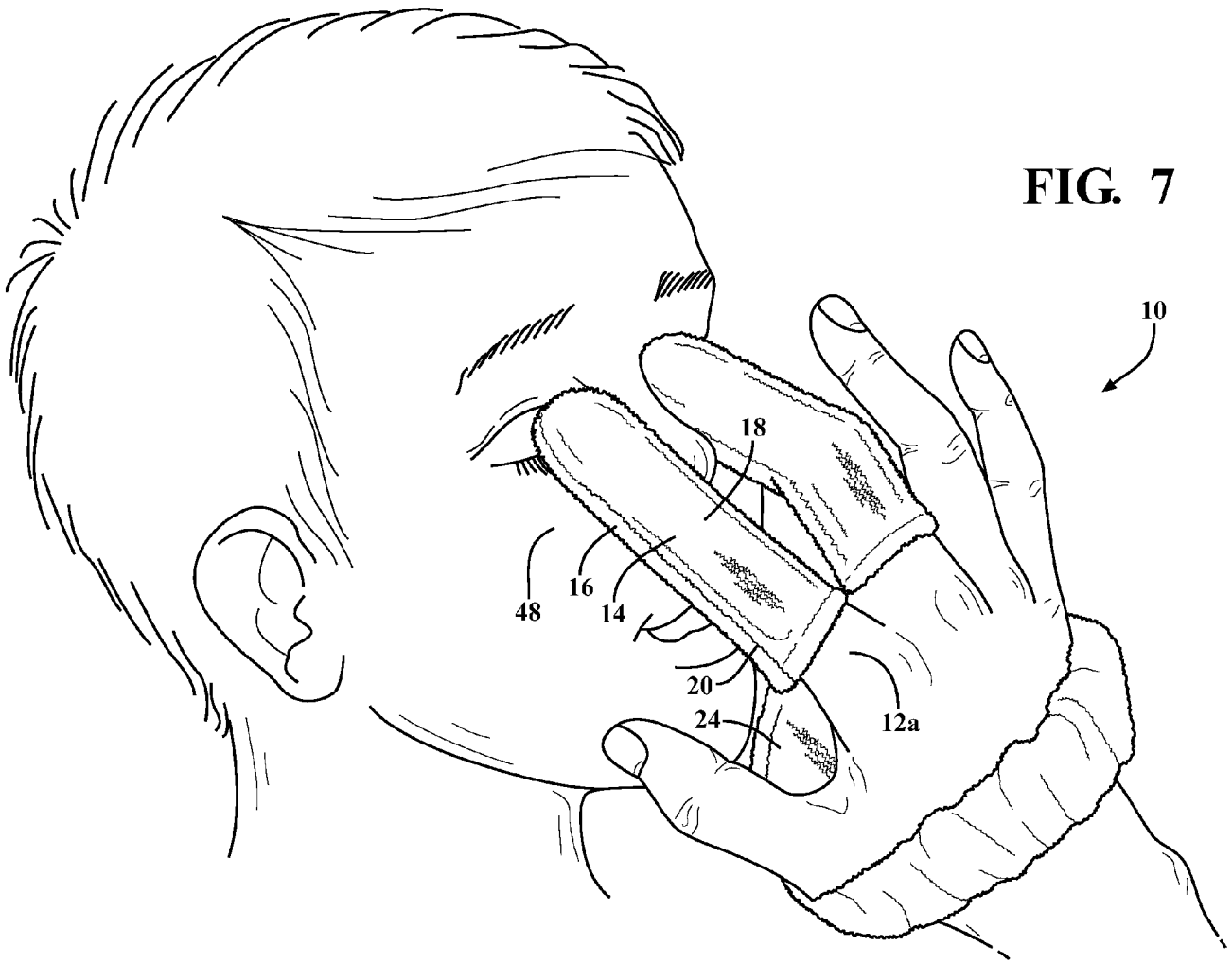
FIG. 7 is an illustration of a perspective view of a wash cloth cleaning an individual's face in accordance with a second aspect of the present disclosure.
Figure 8:
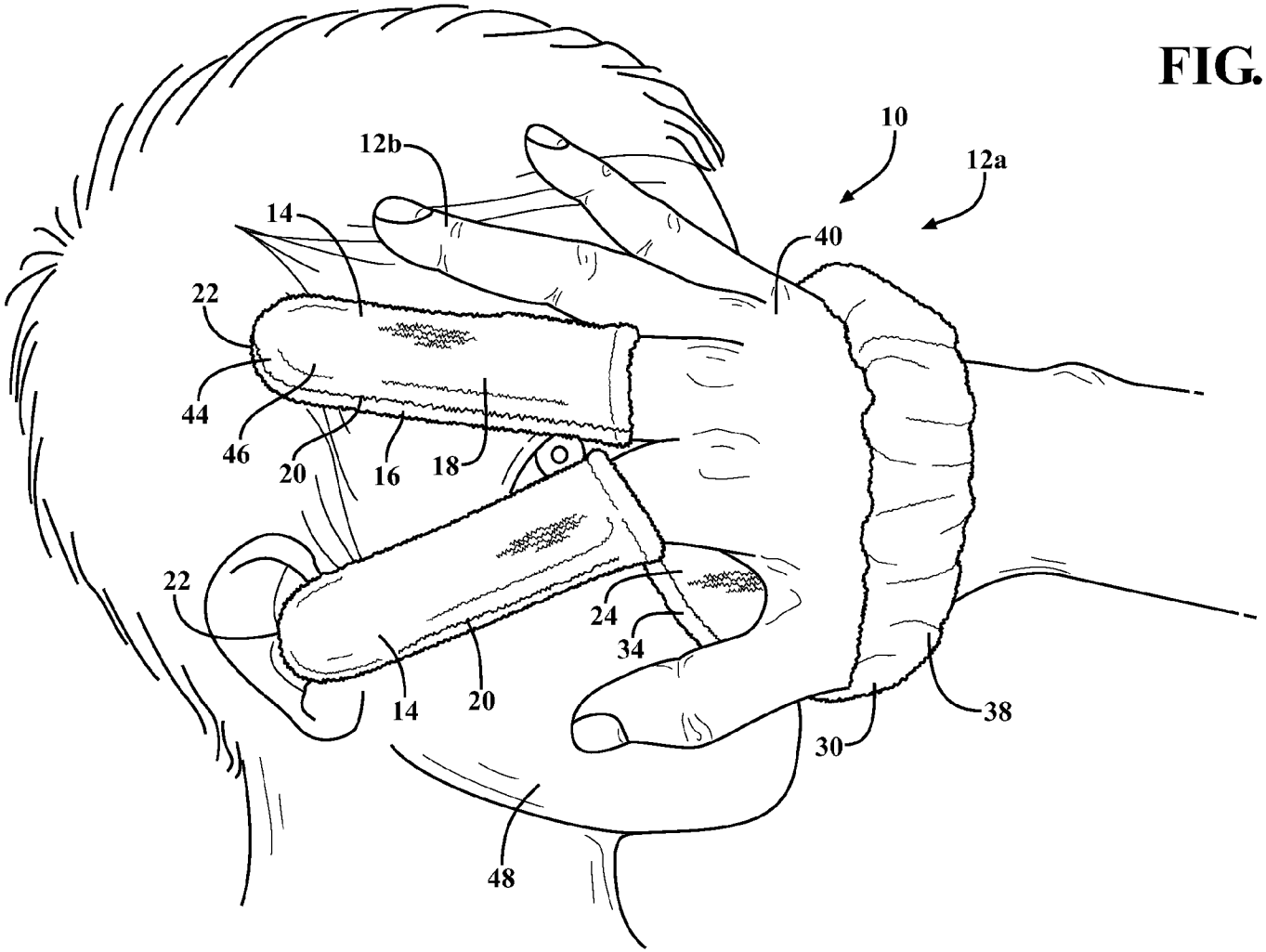
FIG. 8 is an illustration of a perspective view of a wash cloth cleaning an individual's face in accordance with a third aspect of the present disclosure.

With respect to both FIG. 1 and FIG. 2, in the preferred embodiment, the at least one finger cot 14 fits or is disposed over the user's hand 12*a*. The first side 16 of the at least one finger cot 14 being disposed over the front of the user's fingers 12*b* as shown in FIG. 1 and the second side 18 of the finger cot 14 being disposed over the back of the user's fingers 12*b* as shown in FIG. 2. The at least one finger cot 14 may allow the user to clean small areas or small crevices of the user or individual's body including, but not limited to, the user or individual's face, teeth, or gums, as shown in FIGS. 6-8. Also, in the preferred embodiment, the palm portion 24 may be disposed on the palm of the user's hand 12*a*, which may be secured by the elastomeric portion 30 engaging the back 40 of the hand 12*a*. The palm portion 24 may be used to clean all areas of the user or individual's body and may act as support for the at least one finger cot 14 when cleaning certain portions of the body as shown in FIG. 8.

Figure 3:
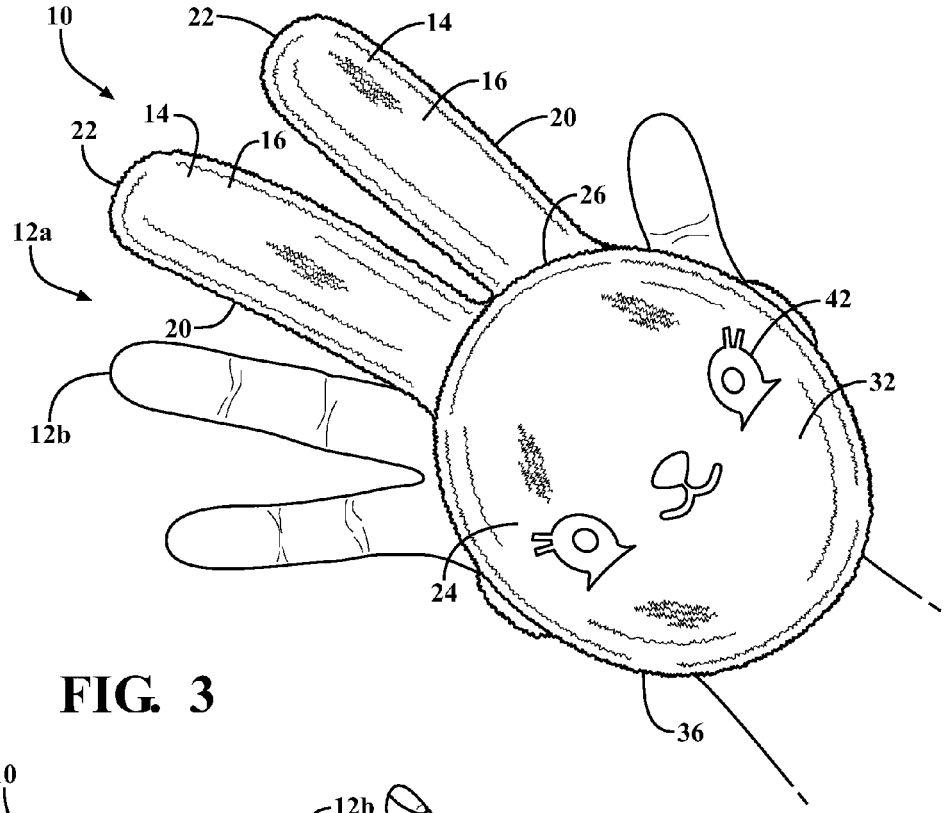
FIG. 3 is an illustration of a palm view of a wash cloth on a user's hand in accordance with an aspect of the present discloses.
Figure 4:
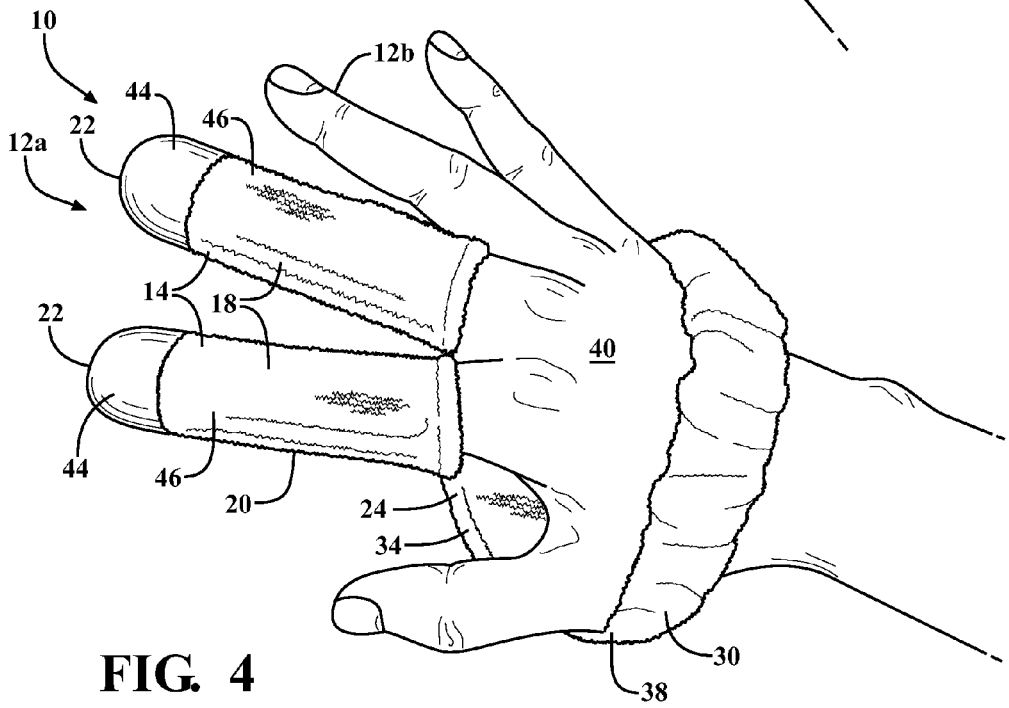
FIG. 4 is an illustration of aback view of a wash cloth on a user's hand in accordance with a second aspect of the present disclosure.
Figure 5:
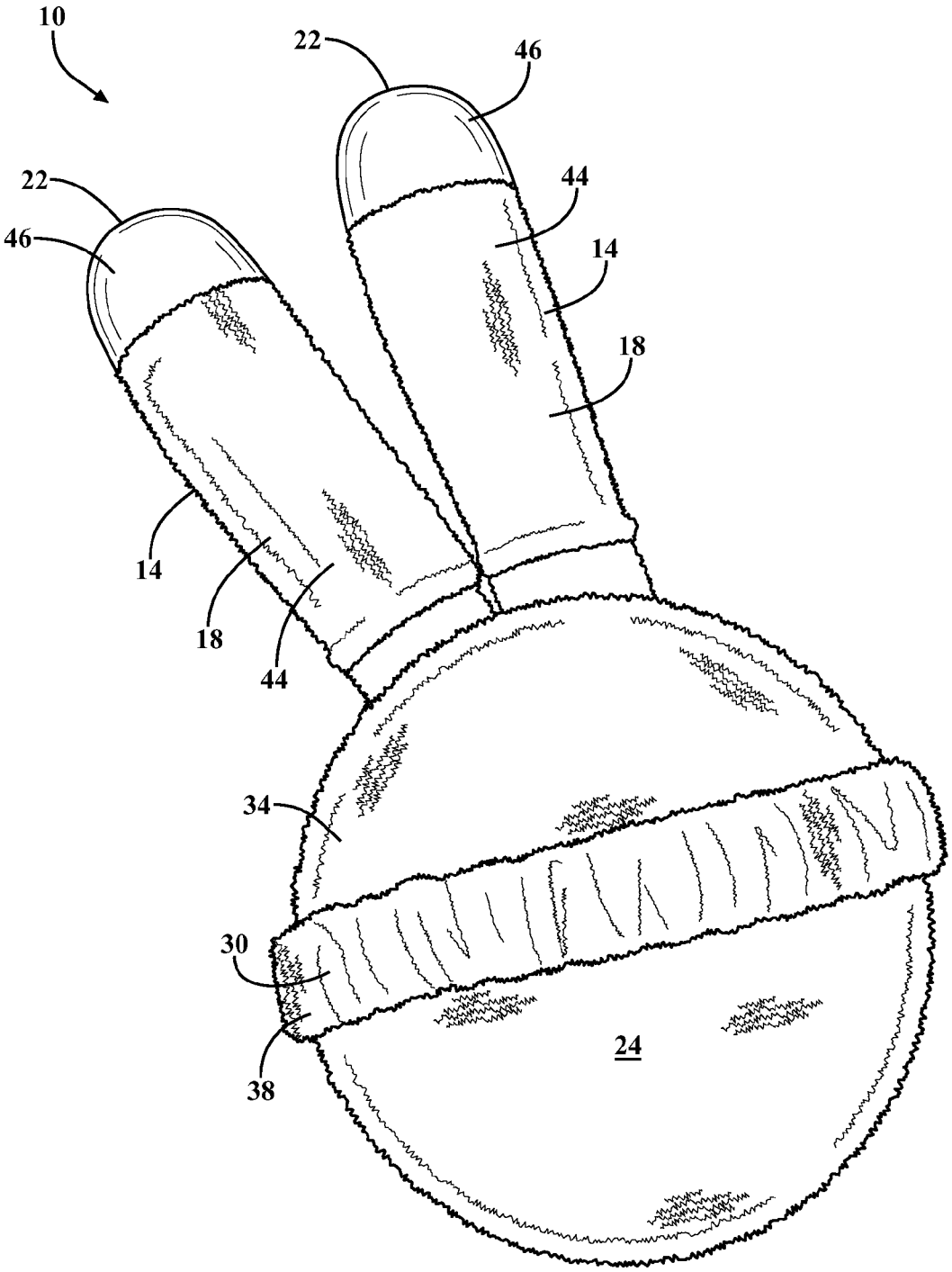
FIG. 5 is an illustration of a back view of a wash cloth with an alternative aspect in accordance with the present disclosure.

FIGS. 3-5 show additional and alternative aspect of the wash cloth 10. Specifically, FIG. 3 illustrates a front view of the wash cloth 10 disposed on the user's hand 12*a* in accordance with an aspect of the present disclosure. FIG. 4 illustrates a back view of the wash cloth disposed on the user's hand in accordance with another aspect of the present disclosure and FIG. 5 illustrates a back view of the wash cloth not disposed on the user's hand in accordance with an alternative aspect of the present disclosure. In an aspect, the palm portion 24 may include an embroidered portion 42. The embroidered portion 42 may be an animal face, which can be used to entertain, calm, or distract a baby or small child when a user such as a parent uses the wash cloth during bath time. However, one skilled in the art appreciates that there may not be an embroidered portion 42 disposed on the palm portion 24, as shown in FIG. 1. In a further aspect, as shown in FIGS. 4 and 5, the second side 18 of the finger cot 14 may include a first portion 44 and a second portion 46. The first portion 44 may be made of the same material as the first side 16 of the finger cot 14 or of a soft absorbing material such as, terry cloth, cotton, or the like. The second portion 46 may be made of a microfiber material, such as a micro-jersey, micro-knit, or the like.

FIGS. 6-8 are illustrations of a user utilizing a wash cloth to clean another individual's face 48. Specifically, FIGS. 6 and 7 show the user using the finger cots 14 to clean small areas or crevices of the individual's face 48, for example, under the individual's nose or around the individual's eyes. With respect to FIG. 8, the palm portion 24 may be used to, wipe the individual's face 48, for example, the individual's cheeks, nose, or forehead.

While examples of the disclosure have been illustrated and described, it is not intended that these examples illustrate and describe all possible forms of the disclosure. Rather, the words used in the specification are words of description rather than limitation, and it is understood that various changes may be made without departing from the spirit and scope of the disclosure. Additionally, the features and various implementing embodiments may be combined to form further examples of the disclosure.

For example, when the user is cleaning the small cervices, teeth, or gums of a baby, a physically disabled person, or elderly person's body using the at least one finger cot 14, the palm portion 24 may act as support for wiping liquids off the individual's face, similar to FIG. 8.

What is claimed:

1. A wash cloth, comprising:

at least one finger cot having a first side opposite a second side, a closed end forming an apex, and an open end opposite the apex;

a substantially flat palm portion being attached to the first side of the at least one finger cot, wherein the at least one finger cot extends outwardly from a periphery of the palm portion such that the open end of the finger cot is free and unattached to the palm portion, and wherein the first and second sides of the at least one finger cot each having a length extending from the apex to the periphery of the palm portion, and an elastomeric portion having opposite ends, the ends of the elastomeric portion are attached to and extend across opposite portions of the palm portion and defines a space therebetween, wherein the wash cloth is configured to slide over a user's hand and wherein the at least one finger cot is configured to receive a respective one of the user's fingers, wherein the inner facing side of the palm portion engages a palm of the user's hand, and the elastomeric portion engages the back of the user's hand to secure the palm portion to the palm of the user's hand.

2. The wash cloth of claim 1, wherein the at least one finger cot is two finger cots.

3. The wash cloth of claim 2, wherein the two finger cots include a first finger cot for receiving a first finger and a second finger cot for receiving a second finger.

4. The wash cloth of claim 1, wherein the first side and the second side are fastened together at a seam.

5. The wash cloth of claim 1, wherein the first side is made of a soft absorbing material.

6. The wash cloth of claim 5, wherein the soft absorbing material is terry cloth.

7. The wash cloth of claim 1, wherein the second side is made of a microfiber material.

8. The wash cloth of claim 7, wherein the microfiber material is micro-jersey.

9. The wash cloth of claim 1, wherein the second side includes a first portion made of a soft absorbing material and a second portion made of a microfiber material.

10. The wash cloth of claim 1, wherein the second side includes an elastomeric piece to secure the at least finger one cot to the user's finger.

11. The wash cloth of claim 1, wherein the palm portion is made of a soft absorbing material.

12. The wash cloth of claim 1, wherein the palm portion and the first side of the at least one finger cot form a second seam.

13. The wash cloth of claim 1, wherein the elastomeric portion is an elastic strap.

14. The wash cloth of claim 1, further including a cloth portion covering the elastomeric portion.

15. A wash cloth, comprising:

at least one finger cot having a first side opposite a second side, a closed end forming an apex, and an open end opposite the apex;

a substantially flat palm portion being attached to the first side of the at least one finger cot, wherein the at least one finger cot extends outwardly from a periphery of the palm portion such that the open end of the finger cot is free and unattached to the palm portion, and wherein the first and second sides of the at least one finger cot each having a length extending from the apex to the periphery of the palm portion, and an elastomeric portion having opposite ends, the ends of the elastomeric portion are attached to opposite portions of the periphery of the palm portion such that the elastomeric portion between the ends extends across the palm portion and defines a space therebetween, wherein the at least one finger cot and the palm portion are made of a soft absorbent fabric material, and wherein the wash cloth is configured to slide over a user's hand and wherein the at least one finger cot is configured to receive a respective one of the user's fingers, wherein the inner facing side of the palm portion engages a palm of the user's hand, and the elastomeric portion engages the back of the user's hand to secure the palm portion to the palm of the user's hand.

16. A wash cloth, comprising:

at least one finger cot having a first side opposite a second side, a closed end forming an apex, and an open end opposite the apex;

a substantially flat palm portion being attached to the first side of the at least one finger cot, wherein the at least one finger cot extends outwardly from a periphery of the palm portion such that the open end of the finger cot is free and unattached to the palm portion, and wherein the first and second sides of the at least one finger cot each having a length extending from the apex to the periphery of the palm portion, and an elastomeric portion having opposite ends, the ends of the elastomeric portion are attached to opposite portions of the periphery of the palm portion such that the elastomeric portion between the ends extends across the palm portion and defines a space therebetween, wherein at least a portion of the at least one finger cot and the palm portion are made of a soft absorbent fabric material, and wherein the wash cloth is configured to slide over a user's hand and wherein the at least one finger cot is configured to receive a respective one of the user's fingers, wherein the inner facing side of the palm portion engages a palm of the user's hand, and the elastomeric portion engages the back of the user's hand to secure the palm portion to the palm of the user's hand.

* * * * *